US007841277B1

(12) United States Patent
Van Denend

(10) Patent No.: US 7,841,277 B1
(45) Date of Patent: Nov. 30, 2010

(54) LAYERED STRUCTURE OF A PRINTING PLATE FOR PRINTING SOLID AREAS AND HIGHLIGHT AREAS

(76) Inventor: Mark E. Van Denend, 349 E. 36th St., Paterson, NJ (US) 07504

( * ) Notice: Subject to any disclaimer, the term of this patent is extended or adjusted under 35 U.S.C. 154(b) by 126 days.

(21) Appl. No.: 11/964,205

(22) Filed: Dec. 26, 2007

(51) Int. Cl.
*B41N 1/00* (2006.01)

(52) U.S. Cl. ..... 101/395; 101/376; 101/375

(58) Field of Classification Search ..... 101/327, 101/333, 150, 153, 395, 401.1
See application file for complete search history.

(56) References Cited

U.S. PATENT DOCUMENTS

| | | | | |
|---|---|---|---|---|
| 3,832,948 | A | 9/1974 | Barker | |
| 5,074,209 | A | 12/1991 | Prittie | |
| 5,275,102 | A | 1/1994 | Prittie | |
| 5,777,650 | A * | 7/1998 | Blank | 347/103 |
| 6,192,798 | B1 | 2/2001 | Rorke et al. | |
| 6,213,018 | B1 | 4/2001 | Samworth | |
| 6,492,095 | B2 | 12/2002 | Samworth | |
| 6,588,340 | B2 | 7/2003 | Friedman | |
| 6,698,354 | B2 | 3/2004 | Juffinger et al. | |
| 6,731,405 | B2 | 5/2004 | Samworth | |
| 6,966,259 | B2 * | 11/2005 | Kanga et al. | 101/395 |
| 6,989,220 | B2 * | 1/2006 | Kanga | 430/14 |
| 7,126,724 | B2 | 10/2006 | McCrea et al. | |
| 2004/0160644 | A1 | 8/2004 | Samworth | |

* cited by examiner

*Primary Examiner*—Judy Nguyen
*Assistant Examiner*—Shema T Freeman
(74) *Attorney, Agent, or Firm*—Richard M. Goldberg

(57) ABSTRACT

A printing structure for printing on a medium, includes a first layer having an outer surface adapted to receive ink for printing on the medium, the first layer having a first hardness and/or a first surface energy; and a second layer positioned outside of the first layer, the second layer having an outer surface adapted to receive ink for printing on the medium and the second layer having a second hardness which is less than the first hardness and/or a second surface energy which is greater than the first surface energy, and portions of the second layer are removed to expose the outer surface of the first layer.

5 Claims, 3 Drawing Sheets

LAYERED STRUCTURE OF A PRINTING PLATE FOR PRINTING SOLID AREAS AND HIGHLIGHT AREAS

BACKGROUND OF THE INVENTION

The present invention relates to generally to printing plates, and more particularly, is directed to a single printing plate for printing both solid areas and highlight areas.

In known printing machines, such as flexographic printing machines, there are a number of printing stations in the printing press. Each inking station includes a printing plate mounted on a printing roller and an anilox roller for supplying ink to the printing plate on the printing roller. Each inking station prints with a different color ink. Accordingly, a web positioned between the impression cylinder of the inking station is printed with the image from the printing plate, with a different color ink at each inking station.

When printing on a web of material, there are solid color areas that are printed on the web as well as highlight color areas which are formed by spaced apart small dots. For example, for the diet cranberry-raspberry drink sold under the trademark "SNAPPLE", there is a label on the bottle which includes solid dark purple areas as well as light purple areas. The solid dark purple areas are best printed generally by a first printing plate, and the light purple areas are highlights formed by spaced apart dots which are best printed by a second printing plate.

Each printing plate is mounted on a printing roller with a sticky back material, in effect, a material having adhesive on opposite sides, one for adhering to the printing roller and the other for adhering to the back of the printing plate.

It is known that the photopolymer printing plates for printing the solid colors have a lower durometer (softer) and a harder sticky back material, while the photopolymer printing plates for printing the highlights (dots) have a higher durometer (harder) and a softer sticky back material. It is also known to print the solid areas with more impression or a higher printing pressure, that is, the printing rollers are positioned closer to the impression cylinder to provide a greater force thereon, while the printing of the highlights occurs with less impression or a lesser printing pressure, that is, the printing rollers are positioned further away from the impression cylinder to provide a lesser force thereon. As a result, there is a higher ink transfer rate for the solid printed areas and a lower ink transfer rate for the highlight printed areas.

The problem with this arrangement is that it generally requires different printing plates, sticky back material and/or anilox roll for the solid areas versus highlight (dots) areas, and often, the durometer of the printing plate and the hardness of the sticky back material is changed in accordance with the required printing.

SUMMARY OF THE INVENTION

Accordingly, it is an object of the present invention to provide a printing plate and method for making the same which can print both solid areas and highlight areas simultaneously with the same printing plate.

It is another object of the present invention to provide a printing plate and method for making the same in which the single printing plate includes different layers of different hardness and/or surface energy and an upper layer is removed by laser ablation to expose outer surfaces of the lower layer.

It is still another object of the present invention to provide a printing plate and method for making the same which greatly reduces the costs and the time for printing.

It is yet another object of the present invention to provide a printing plate and method for making the same which is easy to use and economical to manufacture.

In accordance with an aspect of the present invention, a printing structure for printing on a medium, includes a first layer having an outer surface adapted to receive ink for printing on the medium, the first layer having a first hardness; and a second layer positioned outside of the first layer, the second layer having an outer surface adapted to receive ink for printing on the medium and the second layer having a second hardness which is less than the first hardness, and portions of the second layer are removed to expose the outer surface of the first layer.

There is also a substrate having an outer surface, in which the first layer is positioned on the outer surface of the substrate, and the second layer is positioned on the outer surface of the first layer. The printing structure is a printing plate, a printing sleeve, or a printing cylinder.

Both of the first and second layers are removed in correspondence with areas on the medium at which no printing is to occur.

In a modification, an intermediate layer is positioned between the first and second layers.

In accordance with another aspect of the present invention, a printing structure for printing on a medium, includes a first layer having an outer surface adapted to receive ink for printing on the medium, the first layer having a first surface energy; and a second layer positioned outside of the first layer, the second layer having an outer surface adapted to receive ink for printing on the medium and the second layer having a second surface energy which is greater than the first surface energy, and portions of the second layer are removed to expose the outer surface of the first layer.

In accordance with still another aspect of the present invention, a method of making a printing structure for printing on a medium, includes the steps of forming a first layer having a first hardness and an outer surface adapted to receive ink for printing on the medium; forming a second layer having a second hardness which is less than the first hardness and an outer surface adapted to receive ink for printing on the medium; positioning the second layer outside of the outer surface of the first layer; and removing portions of the second layer to expose the outer surface of the first layer.

In accordance with yet another aspect of the present invention, a method of making a printing structure for printing on a medium, includes the steps of forming a first layer having a first surface energy and an outer surface adapted to receive ink for printing on the medium; forming a second layer having a second surface energy which is greater than the first surface energy and an outer surface adapted to receive ink for printing on the medium; positioning the second layer outside of the outer surface of the first layer; and removing portions of the second layer to expose the outer surface of the first layer.

In addition, the first layer can also have both a first hardness and the first surface energy, and the second layer can also have both a second hardness which is less than the first hardness and the second surface energy which is greater than the first surface energy.

The above and other objects, features and advantages of the invention will become readily apparent from the following detailed description thereof which is to be read in connection with the accompanying drawings.

DETAILED DESCRIPTION

Figure 1:
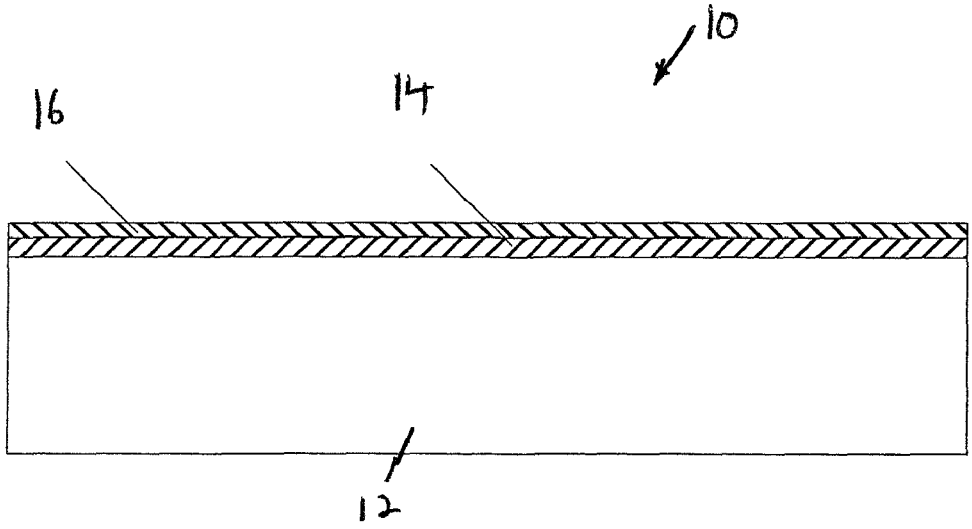
FIG. 1 is a cross-sectional view of a printing plate according to the present invention, prior to laser ablation.

When a liquid is placed on a solid surface, wetting of the surface occurs if the molecules of the liquid have a stronger attraction to the molecules of the solid surface than to each other, that is, the adhesive forces are stronger than the cohesive forces. Alternately, if the liquid molecules are more strongly attracted to each other than to the molecules of the solid surface, the cohesive forces are stronger than the adhesive forces, and the liquid beads up and does not fully wet the surface of the solid and/or a lesser amount of liquid coats the surface of the solid. It will be appreciated that the former arrangement corresponds to the printing of solid areas, and the latter arrangement corresponds to the printing of highlights or dots.

The wetting ability of a liquid is a function of the surface energies of the solid-liquid interface. The surface energy across an interface or the surface tension at the interface is a measure of the energy required to form a unit area of new surface at the interface. The intermolecular bonds or cohesive forces between the molecules of a liquid cause surface tension. When the liquid encounters another substance, there is usually an attraction between the two materials. The adhesive forces between the liquid and the second substance will compete against the cohesive forces of the liquid. Liquids with weak cohesive bonds and a strong attraction to another material will tend to spread over the material. Liquids with strong cohesive bonds and weaker adhesive forces will tend to bead up or form a droplet when in contact with another material.

In accordance with the above, a plate of a higher surface energy will tend to hold more liquid or ink thereon in an evenly, spread out manner than a plate of a lower surface energy. As a result, a plate of higher surface energy, since it holds more ink in such evenly, spread out manner, will tend to transfer more ink to the substrate to be printed. This transfer, of course, is also dependent upon other factors, such as the surface energy of the ink, the anilox roll and the medium to be printed. There are various well known methods of measuring surface energy of a plate. For example, one method includes the measurement of the contact angle between the liquid and plate when a drop of liquid is deposited on the plate. The more the droplet spreads out, the higher the surface energy.

Another factor in determining the amount of ink to be transferred to the medium is the hardness of the plate. It is advantageous to have a softer plate for printing solids. Specifically, during a printing operation in which there is pressure on the plate, such impression of the softer plate will result in a slight deformation or squeegee type action of the softer plate, causing the ink to mechanically spread out and form a uniform solid color. A harder plate, on the other hand, which does not deform as easily with pressure, will not spread the ink, which is advantageous for highlights. A conventional measure of hardness is a Shore hardness test.

As discussed above, however, the problem with this arrangement is that it generally requires different printing plates for the solid versus highlight (dots) areas, as well as generally requiring different sticky back materials for mounting the printing plates, in which the durometer of the printing plate and the hardness of the sticky back material is changed in accordance with the required printing.

As will now be discussed in detail, the present invention avoids this problem by providing a single printing plate with different layers of different hardness and/or surface energy for printing both the solid areas and the highlight (dots) areas.

Referring to the drawings in detail, and initially to FIG. 1, an enlarged portion of a printing plate 10 according to the present invention is shown, with a substrate 12 having a first inner layer 14 on an outer surface thereof, and a second outer layer 16 on the outer surface of first layer 14.

Inner layer 14 is formed with a high durometer hardness, for example, on the order of 75 to 85 Shore A hardness, and/or a low surface energy, so that less liquid or ink is attracted to and held thereon and/or is held thereon in an uneven, spotty manner, which is ideal for printing highlights or dots. On the other hand, outer layer 16 is formed with a lower durometer hardness, for example, on the order of 65 Shore A hardness and/or a higher surface energy, so that more liquid or ink is held thereon and tends to spread out and adhere thereto, which is ideal for printing solid areas.

Layers 14 and 16 are preferably made from an elastomer and/or photopolymer. For example, suitable elastomers include ethylene propylene diene monomer (EPDM) rubber, styrene-butadiene rubber (SBR), butyl rubber, natural rubber and combinations of these rubber materials. A suitable photopolymer may include, for example, one sold by Toray for direct engraving.

To this end, the higher durometer of inner layer 14 can be achieved by providing additives to the above materials, for example, carbon or a filler to increase durometer. Polytetrafluoroethyline or silicon may be added to the materials to decrease the surface energy.

In order to apply the layers, the composition for the inner and outer layers 14 and 16, with or without any additives, is reduced with solvent and has a molasses type consistency, which is then coated on substrate 12 in the case of inner layer 14 and on inner layer 14 in the case of outer layer 16. Thereupon, the solvent is dried off. This operation can be repeated until the desired thicknesses of inner layer 14 and outer layer 16 are achieved.

In summary, the receptivity of the ink to inner layer 14 and outer layer 16 is thereby determined primarily by two factors, namely, the surface energies and the durometer hardnesses, either or both of which can be used.

Figure 2:
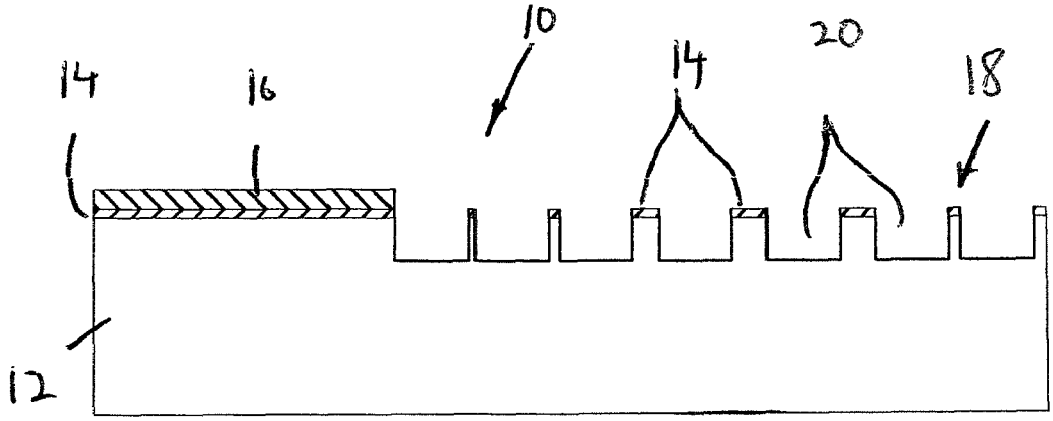
FIG. 2 is a cross-sectional view of the printing plate of FIG. 1 after laser ablation.

With this arrangement, as shown in FIG. 2, material of outer layer 16 is removed, for example, by being laser ablated or cut away, to produce certain islands 18 which expose the outer surface of inner layer 14. In addition, to enable good conduct of the exposed inner layer 14 at islands, and to also reduce any undesirable printing that might occur from adjacent areas where there has been no removal of outer layer 16, recessed areas 20 on which no printing is to occur by printing plate 10 are also preferably removed by laser ablation or the like, including removal of outer layer 16, inner layer 14 and part of substrate 12. Thus, the exposed outer surface of outer layer 16 is used for printing solid areas on a medium 22 such as a web, while the exposed outer surface of inner layer 14 is used for printing highlight areas on medium 22.

As a result, solid areas are printed by ink on outer layer 16 while highlights or dots are printed by ink on exposed inner layer 14. In this regard, it will be appreciated that the thickness of layers 14 and 16 is extremely small, for example, approximately 20 to 50 microns or the like. During a printing operation, because of the pressure applied to the outer surface of printing plate 10, the outer surface of outer layer 16 as well as the outer surface of inner layer 14 at islands 18 will both be in contact with the outer surface of the medium 22 to be printed, so that printing will simultaneously occur from both surfaces.

Figure 3:
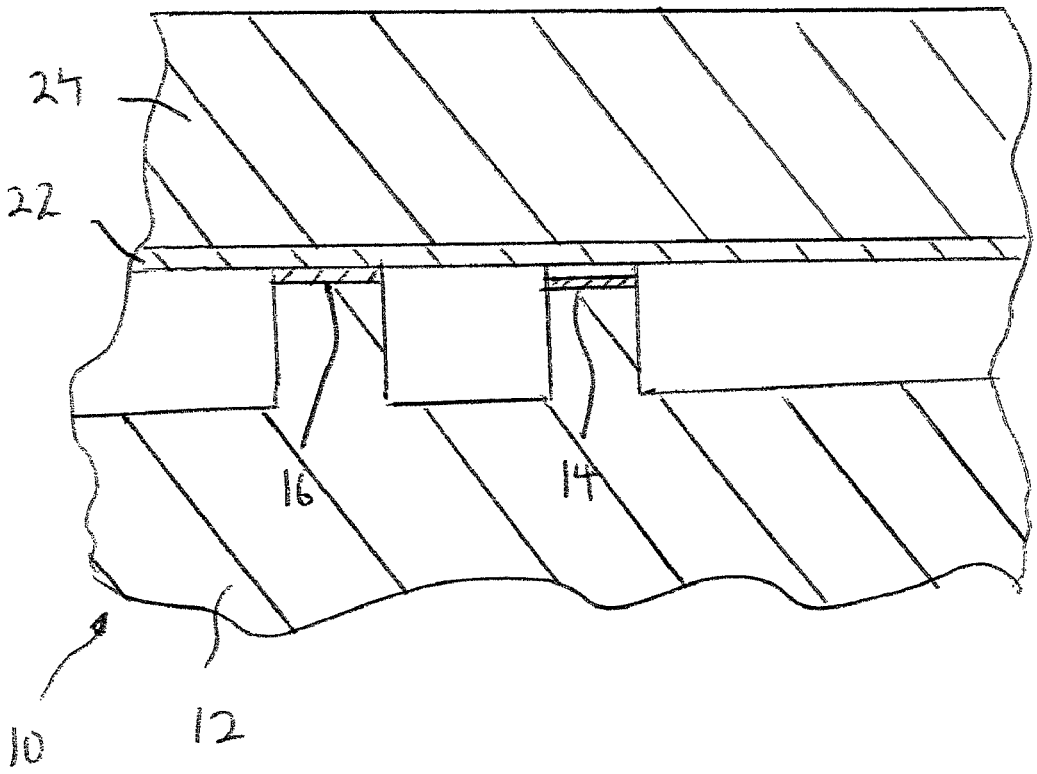
FIG. 3 is an enlarged cross-sectional view of the printing plate of FIG. 2 during a printing operation.

Thus, as shown in FIG. 3, during a printing operation, when printing on an outer surface of a medium, such as a web of material 22 sandwiched between printing plate 10 and an impression roller 24, outer layer 16, because of its lower durometer hardness, will deform and compress more than inner layer 14. Ink on outer layer 16, because of the lower durometer of outer layer 16, will adhere and spread out along the outer surface of outer layer 16. Therefore, because of the lower durometer and the increased pressure on outer layer 16, the ink thereon will be deposited on web 22 as a solid area.

In addition, a higher surface energy of outer layer 16 will attract and hold more ink thereon. Thus, there is more ink to be transferred to the medium, which further functions to print solid areas. It will be appreciated, however, that either hardness or surface energy, or both, can be used for adjusting the characteristics of outer layer 16.

On the other hand, inner layer 14, because of its higher durometer hardness, will compress less than outer layer 16. Ink on the outer exposed surface of inner layer 14 at islands 18, because of the higher durometer of inner layer 14, will not spread when printed. Therefore, because of the higher durometer and the reduced pressure on inner layer 14, the ink thereon will be deposited on web 22 as a better highlight dot.

In addition, a lower surface energy of inner layer 14 will attract and hold less ink thereon. Thus, there is less ink to be transferred to the medium, which further functions to print highlight areas. It will be appreciated, however, that either hardness or surface energy, or both, can be used for adjusting the characteristics of inner layer 14.

As such, a single color at a single printing station can be used to simultaneously print the solid areas with outer layer 16 and the highlight (dots) areas with inner layer 14.

It will be appreciated, therefore, that there are two factors associated with the use of layers 14 and 16 for printing either solids or highlights. Specifically, for printing solid areas, outer layer 16 has a lower durometer hardness and/or higher surface energy so that more ink is held thereon and tends to spread out evenly. Further, the pressure applied to outer layer 16 is greater because the outer surface thereof is closer to web 22. For printing highlight areas, inner layer 14 has a higher durometer hardness and/or lower surface energy so that less ink is held thereon and does not tend to spread when printed. Further, the pressure applied to inner layer 14 is lower.

While the present invention has been discussed in regard to a printing plate 10, it will be appreciated that layers 14 and 16 can be formed on a sleeve which is mounted on a printing cylinder, or alternatively, the printing cylinder itself can have the layers 14 and 16 thereon.

Further, although only two layers 14 and 16 have been discussed, more than two layers can be provided and each layer can be formed from a plurality of different coatings thereon. Thus, a multitude of layers can be formed, each with a different surface energy and/or durometer hardness in order to vary the type of printing produced thereby.

Figure 4:
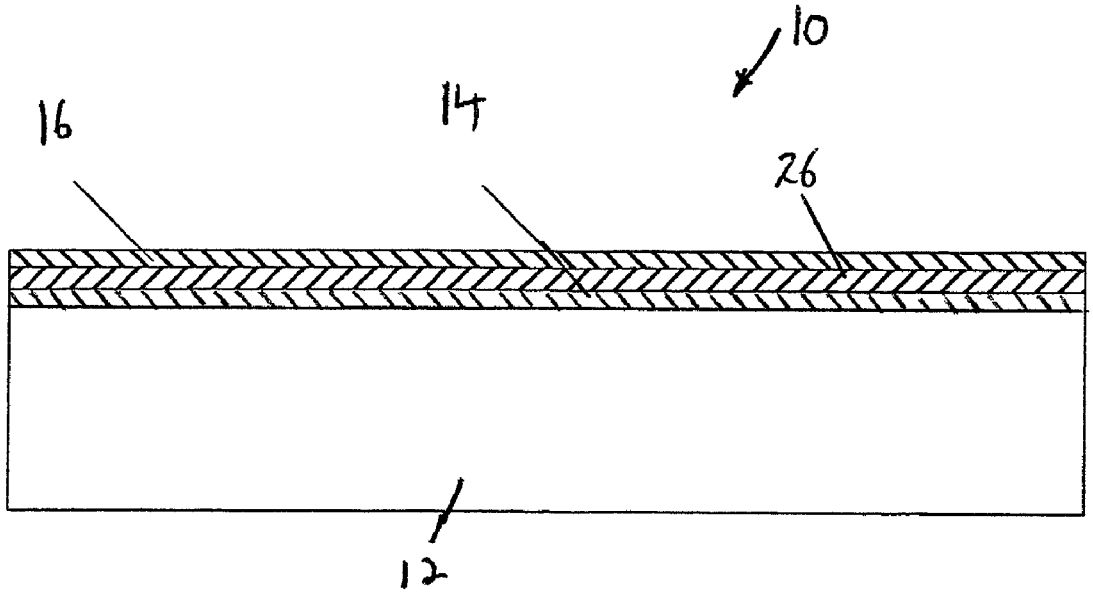
FIG. 4 is a cross-sectional view similar to FIG. 1, showing an intermediate layer.

Thus, as shown in FIG. 4, an intermediate layer 26 can be positioned between inner layer 14 and outer layer 16.

Thus, the present invention provides for a printing surface having different layers thereon with different characteristics of surface energy and/or durometer hardness, and with the outer layer 16 burned away to expose portions of the inner layer or layers 14 for printing highlights or dots, so that the different layers on the same printing plate can be used simultaneously for printing solid areas and highlight areas.

Of course, it will be appreciated that it is possible to reverse the order of the layers described above.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A printing structure for printing on a medium by transferring ink from the printing structure onto the medium, comprising: a substrate having an outer surface, a first layer positioned on the outer surface of said substrate, the first layer having a first hardness; and a second layer positioned on the surface of said first layer opposite the substrate, said second layer having an outer surface that receives ink from the anilox roller, the second layer having a second hardness which is different than said first hardness, and where portions of said second layer have been removed to expose portions of said outer surface of said first layer such that ink is capable of being transferred to said exposed portions of said first layer and to said outer surface of said second layer at substantially the same time from the anilox roller, and said second layer having a thickness less than 50 microns such that ink from both top outside surfaces of said first and second layers is capable of being transferred to the medium during a printing operation at substantially the same time.

2. A printing structure according to claim 1, wherein both said first and second layers are removed in correspondence with areas on the medium at which no printing is to occur.

3. A printing structure according to claim 1, further comprising at least one intermediate layer positioned between said first and second layers.

4. A printing structure according to claim 1, wherein said second hardness is less than said first hardness.

5. A printing structure according to claim 1, wherein said second layer has a thickness in a range of approximately 20 microns to 50 microns.

* * * * *